US009793633B2

(12) United States Patent
Liao

(10) Patent No.: US 9,793,633 B2
(45) Date of Patent: Oct. 17, 2017

(54) ELECTRICAL CONNECTOR WITH A GROUNDING BAR CONNECTING THE TERMINALS OF A PLURALITY OF GROUND CONTACT WAFERS AND SHIELDING BRAIDS OF CABLES

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/222,980

(22) Filed: Jul. 29, 2016

(65) Prior Publication Data

US 2017/0033482 A1 Feb. 2, 2017

(30) Foreign Application Priority Data

Jul. 31, 2015 (CN) ..... 2015 2 0567552 U

(51) Int. Cl.
*H01R 24/00* (2011.01)
*H01R 12/72* (2011.01)
(Continued)

(52) U.S. Cl.
CPC ..... *H01R 12/721* (2013.01); *H01R 12/75* (2013.01); *H01R 13/05* (2013.01); *H01R 13/514* (2013.01);
(Continued)

(58) Field of Classification Search
CPC .... H01R 12/716; H01R 12/721; H01R 12/73; H01R 12/737; H01R 12/85; H01R 13/514;
(Continued)

(56) References Cited

U.S. PATENT DOCUMENTS 5,259,768 A * 11/1993 Brunker ..... H01R 13/6474 29/874
5,522,737 A * 6/1996 Brunker ..... H01R 13/6474 439/60
(Continued)

FOREIGN PATENT DOCUMENTS

CN 201708387 1/2011

*Primary Examiner* — Chandrika Prasad
(74) *Attorney, Agent, or Firm* — Wei Te Chung; Ming Chieh Chang

(57) ABSTRACT

A cable connector includes an insulative shell defining a receiving cavity extending along a front-to-back direction, a number of contact wafers retained in the receiving cavity, a number of cables, and a ground bar. The contact wafers include a number of signal contact wafers and a number of ground contact wafers arranged alternately. Each of the contact wafers includes an insulative housing and a number of terminals retained in the insulative housing. Each of the terminals includes a deflectable contacting section, a middle section, and a tail section. Each of the cables includes a conductive core connecting with a corresponding tail section and a shielding braid surrounding around the conductive core. The ground bar physically and electrically connects with the tail sections of the ground wafers and the shielding braids.

17 Claims, 7 Drawing Sheets

(51) Int. Cl.

| | |
|---|---|
| *H01R 12/75* | (2011.01) |
| *H01R 13/05* | (2006.01) |
| *H01R 13/514* | (2006.01) |
| *H01R 13/6597* | (2011.01) |
| *H01R 24/58* | (2011.01) |
| *H01R 24/60* | (2011.01) |
| *H01R 31/08* | (2006.01) |
| *H01R 107/00* | (2006.01) |

(52) U.S. Cl.
CPC ..... *H01R 13/6597* (2013.01); *H01R 24/58* (2013.01); *H01R 24/60* (2013.01); *H01R 31/08* (2013.01); *H01R 2107/00* (2013.01)

(58) Field of Classification Search
CPC .... H01R 13/645; H01R 13/74; H01R 13/658; H01R 13/6582; H01R 13/6581; H01R 13/6585; H01R 13/6586; H01R 13/6596; H01R 13/65802
USPC ..... 439/634–640, 101, 607.05
See application file for complete search history.

(56) References Cited

U.S. PATENT DOCUMENTS

| | | | | |
|---|---|---|---|---|
| 5,580,257 | A * | 12/1996 | Harwath | H01R 12/721 439/108 |
| 6,099,328 | A | 8/2000 | Nelson et al. | |
| 6,309,254 | B1 * | 10/2001 | Korsunsky | H01R 12/721 439/60 |
| 6,939,174 | B2 | 9/2005 | Wu | |
| 2007/0149002 | A1 * | 6/2007 | Liao | H01R 12/57 439/71 |
| 2007/0224887 | A1 * | 9/2007 | Liao | H01R 13/2435 439/660 |
| 2009/0176400 | A1 * | 7/2009 | Davis | H01R 13/506 439/352 |
| 2013/0273781 | A1 * | 10/2013 | Buck | H01R 13/516 439/626 |
| 2014/0242844 | A1 * | 8/2014 | Wanha | H01R 13/516 439/626 |
| 2014/0329415 | A1 * | 11/2014 | Liao | H01R 12/598 439/660 |
| 2015/0079845 | A1 * | 3/2015 | Wanha | H01R 13/6477 439/607.41 |

* cited by examiner

ELECTRICAL CONNECTOR WITH A GROUNDING BAR CONNECTING THE TERMINALS OF A PLURALITY OF GROUND CONTACT WAFERS AND SHIELDING BRAIDS OF CABLES

BACKGROUND OF THE INVENTION

1. Field of the Invention

The present invention relates to a cable connector, more particularly to a cable connector adapted to electrically connect with a Central Processing Unit.

2. Description of Related Art

China Patent No. 201708387 issued on Jan. 12, 2011, discloses an electrical connector including an insulative housing, a plurality of terminals retained in the insulative housing, and a metal plate insert-molded in the insulative housing. The metal plate is retained in the housing, but the terminals extend forwardly beyond of the insulative housing. The metal plate can not provide a desirable effect of anti-electromagnetic interference.

An improved cable connector with a desirable effect of anti-electromagnetic interference is desired.

BRIEF SUMMARY OF THE INVENTION

Accordingly, the object of the present invention is to provide a cable connector comprising an insulative shell defining a receiving cavity extending along a front-to-back direction, a plurality of contact wafers retained in the receiving cavity and assembled together along a transverse direction perpendicular to the front-to-back direction, a plurality of cables, and a ground bar. The contact wafers comprise a plurality of signal contact wafers and a plurality of ground contact wafers arranged alternately. Each of the contact wafers comprises an insulative housing retained in the insulative shell and a plurality of terminals retained in the insulative housing. Each of the terminals comprises a deflectable contacting section received in the receiving cavity, a middle section buried in the insulative housing, and a tail section extending backwardly beyond of the insulative housing. Each of the cables comprises a conductive core connecting with a corresponding tail section and a shielding braid surrounding around the conductive core. The ground bar physically and electrically connects with the tail sections of the ground wafers and the shielding braids.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
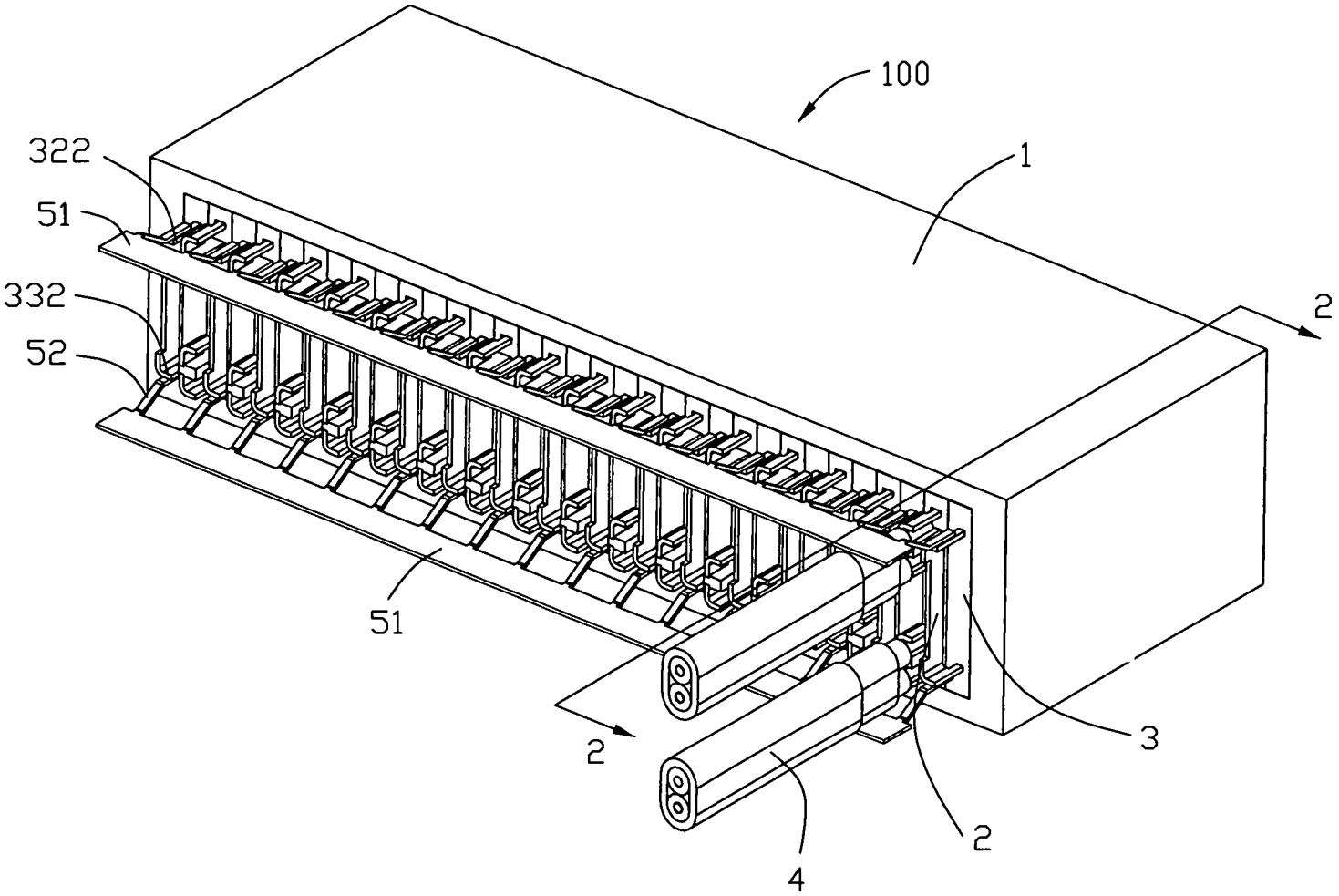
FIG. 1 is a perspective view of a cable connector of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1 to 5, a cable connector 100 is used to electrically connect with a card edge of a Central Processing Unit (CPU). The cable connector 100 includes an insulative shell 1 defining a receiving cavity 11 extending along a front-to-back direction and an insertion opening 12 extending through a front face 10 of the insulative shell 1, a plurality of contact wafers 2, 3 retained in the receiving cavity 11 and assembled together along a transverse direction perpendicular to the front-to-back direction, and a plurality of cables 4. Each of the cables 4 comprises a conductive core 41, a shielding braid 42 surrounding around the conductive core 41 and an insulative layer 43 surrounding around the shielding braid 42. The dimension of the receiving cavity 11 along a vertical direction is larger than the insertion opening's 12. The vertical direction is perpendicular to both the front-to-back direction and the transverse direction. The contact wafers 2, 3 include a plurality of signal contact wafers 2 and a plurality of ground contact wafers 3 arranged alternately with each other. The receiving cavity 11 comprises a first cavity 112, a third cavity 114 and a second cavity 113 communicated therebetween. The insulative housings 21, 31 are retained in the third cavity 114. The dimension of the third cavity 114 along the vertical direction is lager than the first cavity's 112.

Each of the signal contact wafers 2 includes a pair of upper contacts 2*a* and a pair of lower contacts 2*b* integrally formed with an insulative housing 21. The insulative housing 21 forming a first U-shaped configuration in a side view. The pair of upper contacts 2*a* and the pair of lower contacts 2*b* are respectively located in the vertical direction. The pair of upper contacts 2*a* include two first signal terminals 22, 23. The pair of lower contacts 2*b* include two second signal terminals 24, 25. The insulative housing 21 includes a main body portion 211, a first extending portion 212 extending forwardly from a top side thereof, a second extending portions 213 extending forwardly from a bottom side thereof, and a receiving chamber 214 defined by the first and second extending portions 212, 213. The first and second extending portions 212, 213 are symmetrically arranged along the vertical direction. One of the first signal terminals 22 includes a deflectable contacting section 221 received in the receiving cavity 11, a middle section 223 buried in the first extending portion 212, and a tail section 222 extending backwardly beyond of the main body portion 211. The contacting section 221 extends forwardly from a front face of the first extending portion 212 and protrudes downwardly in the receiving cavity 11. The other of the first signal terminal 23 includes a deflectable contacting section 231, a middle section 233 buried in the main body portion 211, and a tail section 232 extending backwardly beyond of the main body portion 211. The deflectable contacting section 231 extends forwardly from the main body portion 211 beyond of the receiving chamber 214 and protrudes upwardly in the receiving cavity 11. Each of the deflectable contacting sections 221, 231 of the first signal terminals 22, 23 has a peak point 224, 234 disposed at a same level along the vertical direction. One of the second signal terminals 24 includes a deflectable contacting section 241 received in the receiving cavity 11, a middle section 243 buried in the second extending portion 213, and a tail section 242 extending backwardly beyond of the main body portion 211. The contacting section 241 extends forwardly from a front face of the second extending portion 213 and protrudes upwardly in the receiving cavity 11. The other of the second signal terminal 25 includes a deflectable contacting section 251, a middle section 253 buried in the main body portion 211, and a tail section 252 extending backwardly beyond of the main body portion 211. The deflectable contacting section 251 extends forwardly from the main body portion 211 beyond of the receiving chamber 214 and protrudes in the receiving cavity 11. Each of the deflectable contacting sections 241, 251 of the second signal terminals 24, 25 has a peak point 244, 254 and the peak points 244, 254 are disposed at a same level along the vertical direction. The first and second signal terminals are symmetrically arranged along an imaginary center horizontal plane of the main body portion 211. The first and second signal terminals can be insert-molded in the insulative housing 21.

Figure 2:
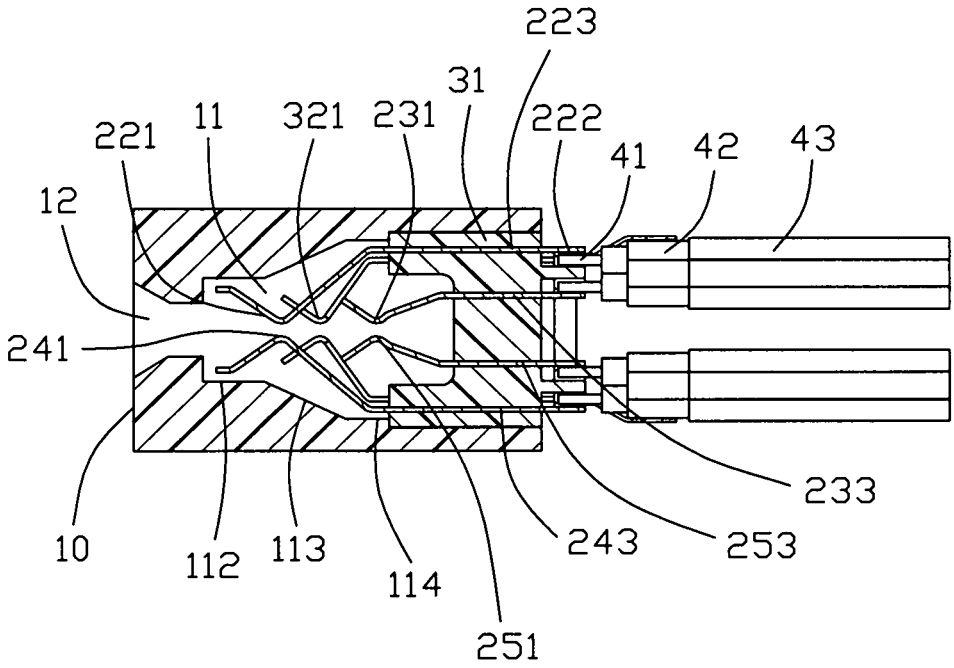
FIG. 2 is a cross-sectional view of the cable connector shown in FIG. 1.
Figure 3:
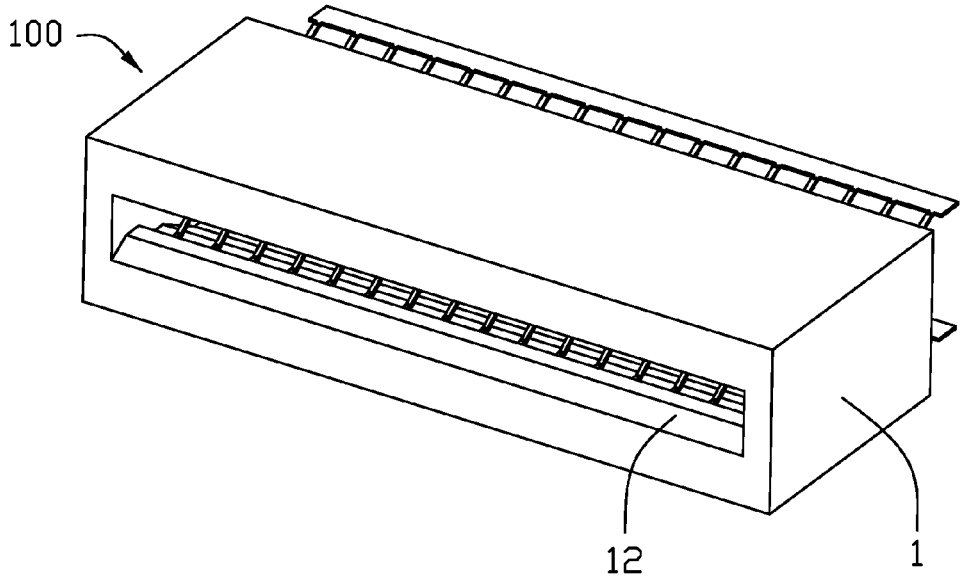
FIG. 3 is another perspective view of the cable connector shown in FIG. 1, wherein the cables are removed.
Figure 4:
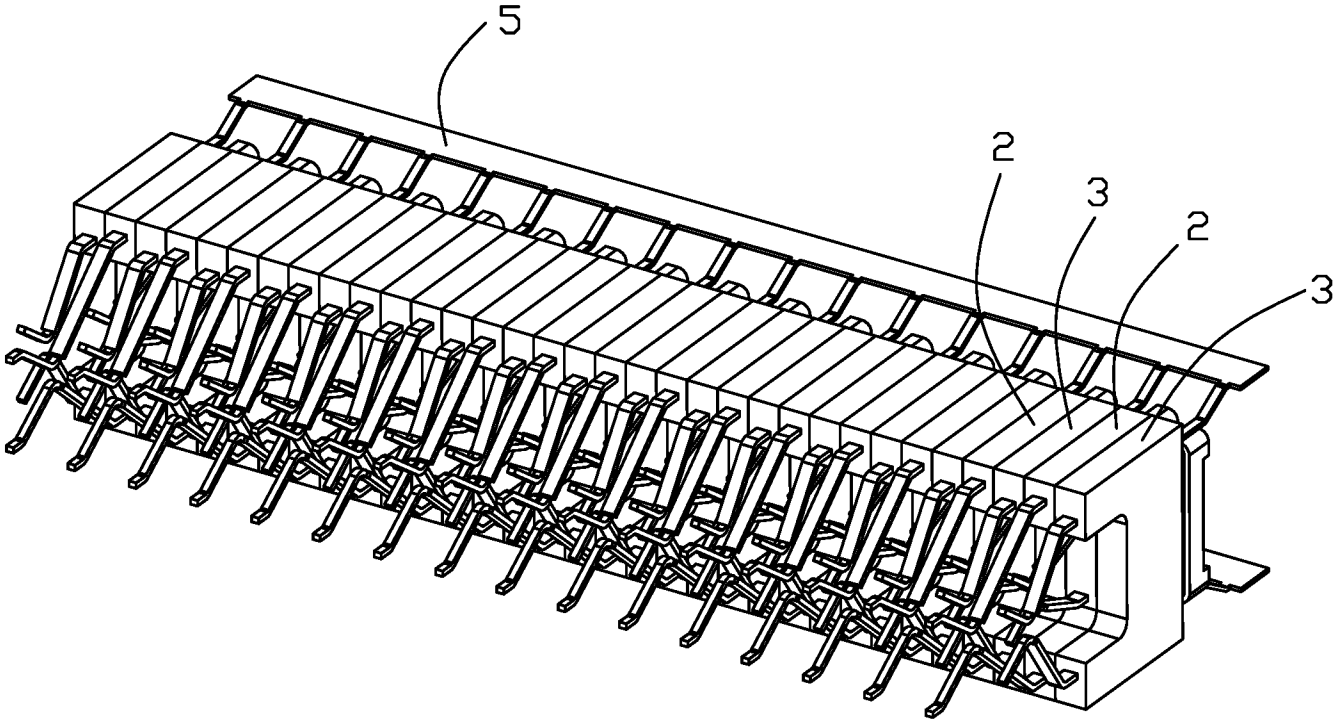
FIG. 4 is a perspective view of the contact wafers shown in FIG. 3.

Each of the ground contact wafers 3 includes an insulative housing 31, a first ground terminal 32, a second ground terminal 33 and a connecting member 34 connected therebetween. The insulative housing 31 includes a main body portion 311, a first extending portion 312 extending forwardly from a top side thereof, a second extending portion 313 extending forwardly from a bottom side thereof, and a receiving chamber 314 defined therebetween. The first and second extending portions 312, 313 are symmetrically arranged along the vertical direction. The first ground terminal 32 includes a deflectable contacting section 321 received in the receiving cavity 11, a middle section 323 received in the first extending portion 312, and a tail section 322 extending backwardly beyond of the main body portion 311. The contacting section 321 extends forwardly from a front face of the first extending portion 312 and protrudes downwardly in the receiving cavity 11. The second ground terminal 33 includes a deflectable contacting section 331 received in the receiving cavity 11, a middle section 333 received in the second extending portion 313, and a tail section 332 extending backwardly beyond of the main body portion 311. The contacting section 331 extends forwardly from a front face of the second extending portion 313 and protrudes downwardly in the receiving cavity 11. Each of the deflectable contacting sections 321, 331 of the ground terminals 32, 33 has a peak point 324, 334 disposed at a same level along the vertical direction. The first and second ground terminals 32, 33 are symmetrically arranged along the vertical direction. Referring to FIG. 2, the peak points 324 of the first ground terminal 32 is located between the peak points 224, 234 of the first signal terminals 22, 23 along the front-to-back direction. The peak point 334 of the first ground terminal 33 is located between the peak points 244, 254 of the second signal terminals 24, 25 along the front-to-back direction. The first and second ground 32, 33 can be insert-molded in the insulative housing 31.

Figure 5:
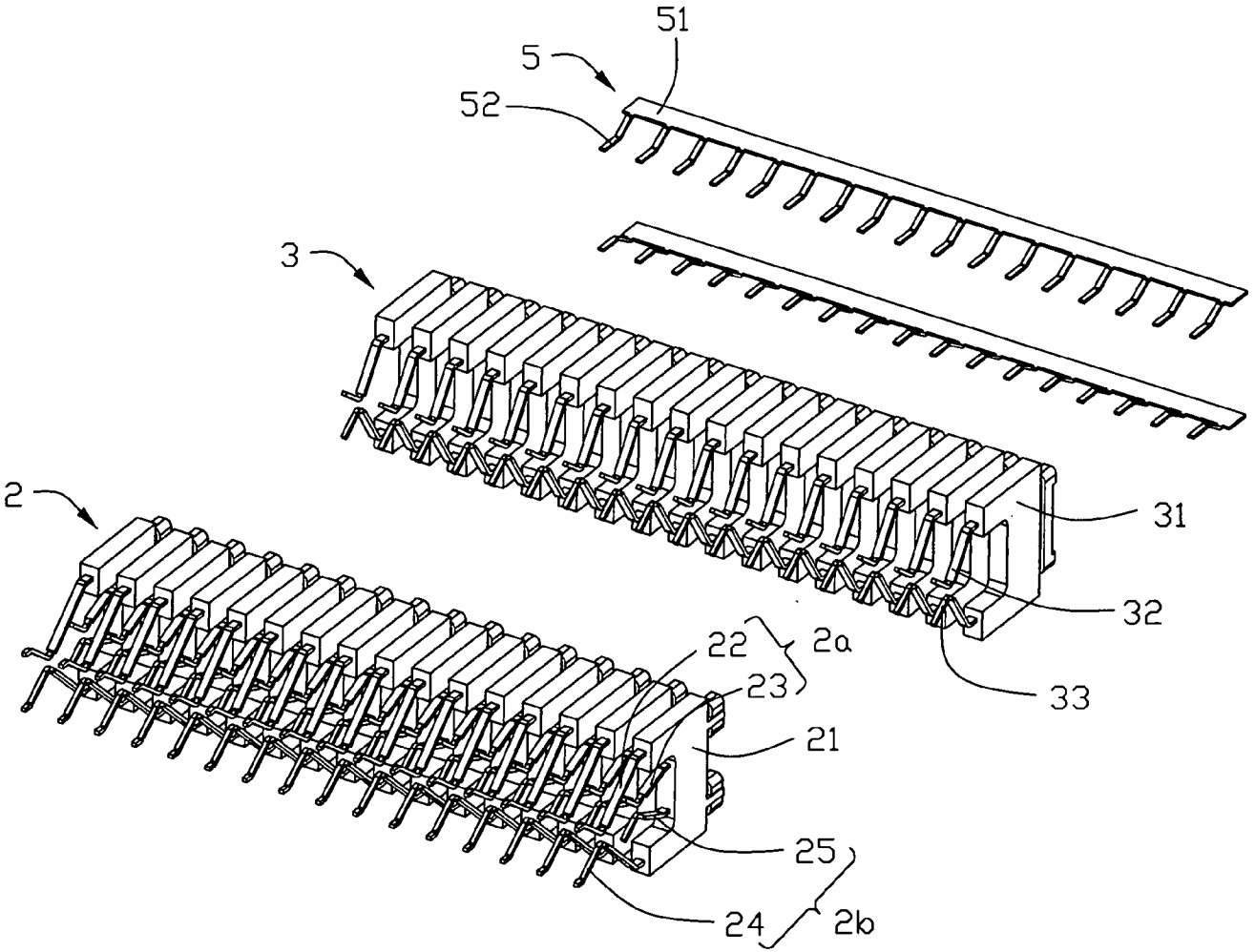
FIG. 5 is an exploded perspective view of the contact wafers shown in FIG. 4.
Figure 6:
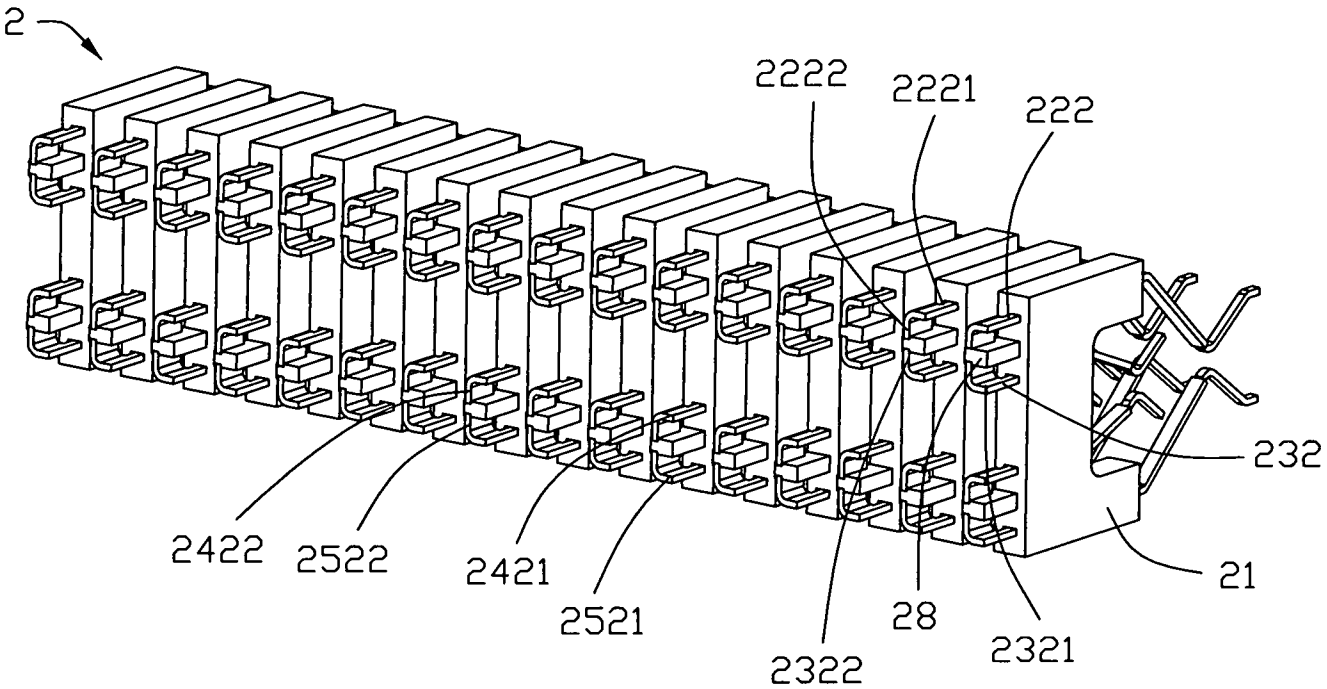
FIG. 6 is another perspective view of the signal contact wafers shown in FIG. 5.
Figure 7:
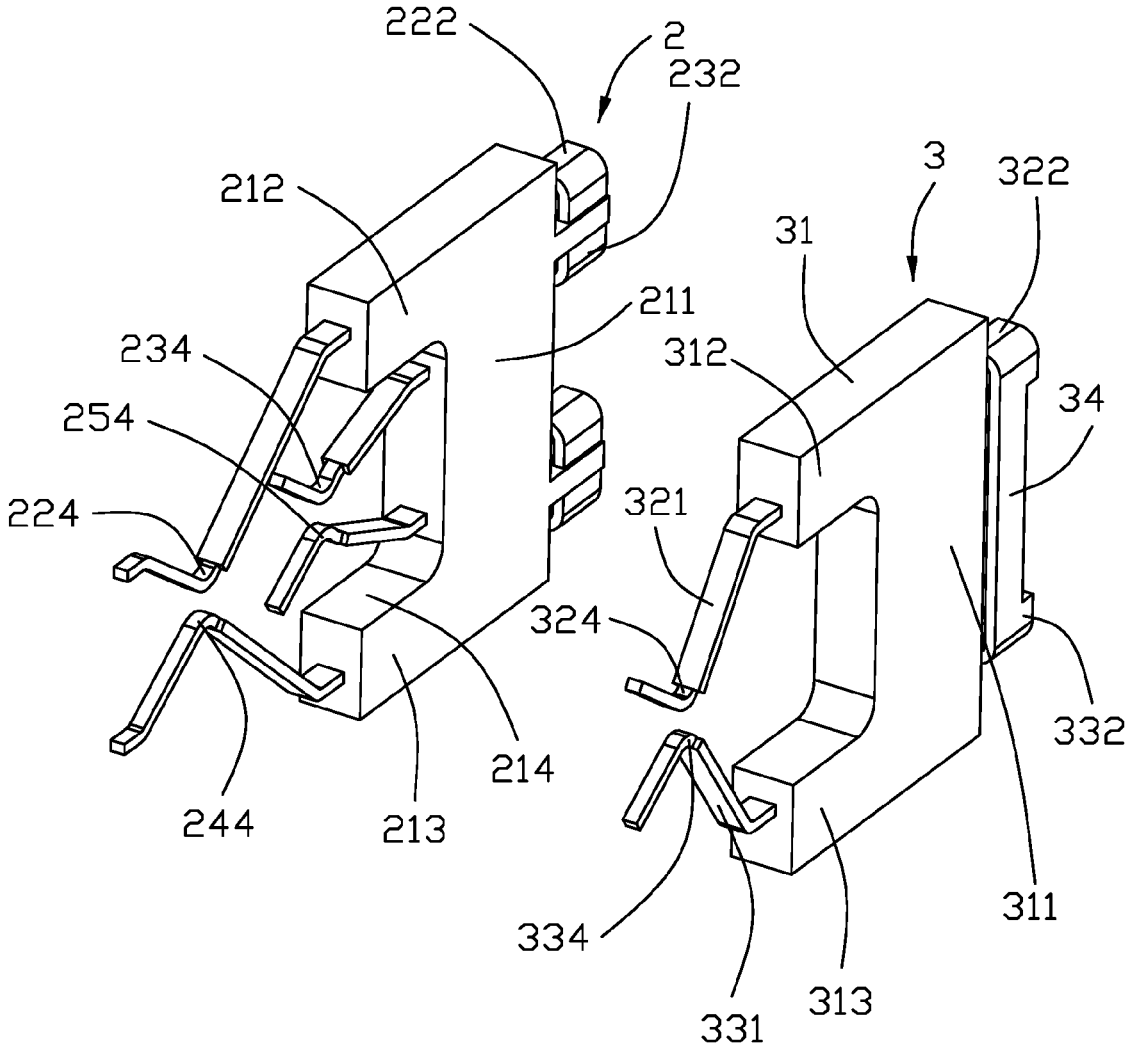
FIG. 7 is a perspective view of a signal contact wafer and aground contact wafer shown in FIG. 5.

Referring to FIGS. 5 and 7, the insulative housings 21 includes a pair of rib portions 28 protruding backwardly from the main body portion 211 to separate two adjacent tail sections of the signal terminals. One of the rib portions 28 is disposed between the tail sections 222, 232 of the two first signal terminals 22, 23 to prevent a short therebetween. The other rib portion 28 is located between the tail sections 242, 252 of the two second signal terminals 24, 25 to prevent a short therebetween. Each of the tail sections 222, 232 of the first signal terminals 22, 23 includes an extending section 2222, 2322 extending vertically and a retaining section 2221, 2321 extending horizontally. Each of the tail sections 242, 252 of the second signal terminals 24, 25 includes an extending section 2422, 2522 extending vertically and a retaining section 2421, 2521 extending horizontally. The retaining section 2221, 2321, 2421, 2521 is formed by a stamping process. The extending section 2222, 2322, 2422, 2522 is formed by a forming process. The conductive cores 41 of the cables 4 are assembled to two opposite lateral sides of the rib portions 28 to solder with the retaining sections and the extending sections of the signal terminals. The cable connector 100 further comprises a pair of ground bars 5 physically and electrically connecting with the tail sections 322, 332 of the ground terminals 32, 33 of the ground wafers 3 and the shielding braids 42. Each of the ground bars 5 comprises a flat body 51 connecting with the shielding braids 42 of the cables 4 and a plurality of protruding tabs 52 extending from the flat body 51 to connect with corresponding tail sections 322, 332 of the ground terminals 32, 33. A receiving slot is defined by the retaining section, the extending section, and the rib portion 28 to receive the conductive core 41 of the cables 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector comprising:

an insulative shell defining a receiving cavity extending along a front-to-back direction;

a plurality of contact wafers retained in the receiving cavity and assembled together along a transverse direction perpendicular to the front-to-back direction, the contact wafers comprising a plurality of signal contact wafers and a plurality of ground contact wafers arranged alternately, each of the contact wafers comprising an insulative housing retained in the insulative shell and a plurality of terminals retained in the insulative housing, each of the terminals comprising a deflectable contacting section received in the receiving cavity, a middle section received in the insulative housing, and a tail section extending backwardly beyond of the insulative housing;

a plurality of cables, each of the cables comprising a conductive core connecting with a corresponding tail section and a shielding braid surrounding around the conductive core; and a ground bar physically and electrically connecting with the tail sections of the terminals of the ground wafers and the shielding braids.

2. The cable connector as claimed in claim 1, wherein each of the signal contact wafers comprises two first signal terminals with the deflectable contacting sections protruding downwardly in the receiving cavity and two second signal terminals with contacting sections protruding upwardly in the receiving cavity.

3. The cable connector as claimed in claim 2, wherein each of the insulative housings comprises a main body portion, a first extending portion extending forwardly from a top side thereof, a second extending portion extending forwardly from a bottom side thereof, and a receiving chamber defined therebetween.

4. The cable connector as claimed in claim 3, wherein one of the two first signal terminals has the deflectable contacting section extending forwardly from the first extending portion, and the other first signal terminal has the deflectable contacting section extending forwardly from the main body portion and beyond of the receiving chamber.

5. The cable connector as claimed in claim 4, wherein each of the deflectable contacting sections has a peak point, and the peak points of the two first signal terminals are disposed at a same level along a vertical direction perpendicular both the front-to-back direction and the transverse direction.

6. The cable connector as claimed in claim 5, wherein the ground contact wafer has a first ground terminal with the deflectable contacting section extending forwardly from the first extending portion, and a second ground terminal with the deflectable contacting section extending forwardly from the second extending portion.

7. The cable connector as claimed in claim 6, wherein the peak point of the first ground terminal is located between the peak points of the first signal terminals along the front-to-back direction.

8. The cable connector as claimed in claim 6, wherein the ground contact wafer has a connecting member connected between the first and second ground terminal.

9. The cable connector as claimed in claim 6, wherein the ground bar comprises a flat body connecting with the shielding braids of the cables and a plurality of protruding tabs extending forwardly from the flat body to connect with corresponding tail sections of the ground terminals.

10. The cable connector as claimed in claim 1, wherein the insulative housing comprises a rib portion protruding backwardly from the main body portion to separate two adjacent tail sections.

11. The cable connector as claimed in claim 10, wherein each of the tail sections includes a retaining section extending horizontally and an extending section extending vertically.

12. The cable connector as claimed in claim 11, wherein a receiving slot is defined by the retaining section, the extending section, and the rib portion to receive the conductive core of the cable.

13. An electrical connector comprising:

a plurality of signal contact wafers and a plurality of grounding contact wafers alternately arranged with each other along a transverse direction;

each of the signal contacts wafer including a pair of upper contacts and a pair of lower contacts integrally formed with an insulative housing, said housing forming a first U-shaped configuration in a side view so as to form a first receiving slot therein, by two sides of said slot said pair of upper contacts and said pair of lower contacts being respectively spaced from each other in a vertical direction perpendicular to said transverse direction;

each of said grounding contact wafers including a pair of contacts integrally formed with an insulative block, said block forming a second U-shaped configuration similar to said first U-shaped configuration in a side view to form a second receiving slot therein by two sides of which said pair of contacts are respectively located in the vertical direction, said second receiving slot being aligned with said first receiving slot in the transverse direction; and a plurality of upper cables and a plurality of lower cable mechanically and electrically connected to the corresponding pair of upper contacts and the corresponding pair of lower contacts, respectively.

14. The electrical connector as claimed in claim 13, wherein in each of said grounding contact wafers, tail sections of the pair of contacts are joined together.

15. The electrical connector as claimed in claim 14, further including an upper grounding bar and a lower grounding bar located behind the alternately arranged signal contact wafers and grounding contact wafer to mechanically and electrically connect shielding braid layers of said upper cables and those of lower cables, respectively.

16. The electrical connector as claimed in claim 15, wherein each of the upper grounding bar further includes a plurality of protruding tabs mechanically and electrically connected to the tail sections of the pair of contacts of the grounding contact wafers.

17. The electrical connector as claimed in claim 13, wherein the pair of upper contacts respectively define front and rear contacting positions space from each other in the front-to-back direction, and the pair of contacts commonly define a contacting position along said front-to-back direction between said front position and said rear position.

* * * * *